US005964655A

United States Patent [19]

Tseng

[11] Patent Number: 5,964,655

[45] Date of Patent: Oct. 12, 1999

[54] CENTRIFUGAL ROTATIONAL COUNTERSINK REAMER FOR THREE-DIMENSIONAL BORES

[76] Inventor: Shao-Chien Tseng, No.130, Sec 2. Yang-Shin Rd., Yang-Mei, Taoyuan 326, Taiwan

[21] Appl. No.: 09/082,755

[22] Filed: May 21, 1998

[51] Int. Cl.[6] ..... B24B 23/02

[52] U.S. Cl. ..... 451/358; 451/344; 451/547; 408/227

[58] Field of Search ..... 451/178, 344, 451/358, 541, 547; 408/199, 227; 29/9.01

[56] References Cited

U.S. PATENT DOCUMENTS 4,220,060 9/1980 Bjodstrup ..... 82/4

*Primary Examiner*—Lowell A. Larson
*Assistant Examiner*—William Hong
*Attorney, Agent, or Firm*—Pro-Tchtor International Services

[57] ABSTRACT

A centrifugal rotational countersink reamer for three-dimensional bores, being comprised mainly of an axial screw typed spring and an encircling screw typed spring, the encircling screw typed spring loosely slips over and encircles the threads of the axial screw typed spring, one end of the axial screw typed spring forms a central rod mounted in a cylindrical seat, the countersink reamer is inserted and fixedly mounted on an electric or pneumatic hand tool or a claw on a drilling machine; then the countersink reamer can be inserted into a rough bore, the hand tool is activated to rotate the countersink reamer, thus the axial screw typed spring creates a centrifugal swivelling wiping action during rotation, the threads of the encircling screw typed spring form grinding blades to abrase during rotation rough edges, especially the rough edges in the rough bore or on the three-dimensional interior/exterior bore rims located in a narrow area which makes the rough edges hard to be accessed for grinding. The reamer can solve the technical impediments resided in the conventional grinding and countersink reaming work on three-dimensional interior/exterior bores.

2 Claims, 3 Drawing Sheets

CENTRIFUGAL ROTATIONAL COUNTERSINK REAMER FOR THREE-DIMENSIONAL BORES

BACKGROUND OF THE INVENTION

1. Field of the Invention

The present invention relates to a centrifugal rotational countersink reamer for three-dimensional bores, and especially to a countersink reamer which can be easily locked on a conventional general electric or pneumatic hand tool or on a drilling machine, for simple and fast abrasing rough edges on three-dimensional bores which are made by the drilling machine and which are provided on a narrow area and thus are hard to be ground originally.

2. Description of the Prior Art

Conventionally in mechanical processing, the ways for making a bore on a workpiece include smooth turning, milling, drilling etc., wherein, a bore made by the way of smooth turning is most delicate, however, the diameter shaped normally is limited by the shape of the turning tool used, a very small bore can not be made by this way; the interior bore rim of a bore made by the way of smooth turning is further defective in overlay slow speed of processing. Hence, most manufacturers merely take the way of milling or drilling, in order to get the required bores quickly.

However, the bores made by milling or drilling, especially the interior bore rims of such bores, are exceptionally subjected to forming of rough edges, these rough edges on the bore rims will be the impediments of the assembling members, thereby, the accuracy of assembling can be adversely influenced.

Bores made by milling or drilling are not limited to the areas of two-dimensional planes, practically, quite a lot of such bores are made on the workpieces having three-dimensional arciform contours, the interior/exterior bore rims of such bores similarly have three-dimensional arciform contours, however, the rough edges formed on the interior/exterior bore rims will be even harder to be eliminated. Particularly, the well known conventional and specific smoothing turning tool for turning bores can be used to get rid of the rough edges on the interior/exterior bore rims and on the walls of the two-dimensional bores and to execute countersink-reaming; but it can not complete eliminating of the rough edges on the interior/exterior bore rims of the three-dimensional bores and countersink-reaming; therefore, sand wheels or sponge wheels etc. are relied upon for grinding, and some may use a vibrational grinding process, to eliminate the rough edges on the bore rims of the two-dimensional or even the three-dimensional bores; it is known however, sand wheels and sponge wheels for grinding can only be used to eliminate the rough edges on the exterior bore rims on a two-dimensional plane, they can not be placed in the areas allowing them to eliminate the rough edges on the interior bore rims on a two-dimensional plane or even on a three-dimensional arciform surface on a workpiece and to ream countersinks, these rough edges appear in a narrow and small bore, on a wall at a distal end or in a corner, or in an enclosed pipe hole, and neither the vibrational grinding processes using grinding granules can do the same. Specially those rough edges on the small bores, they can even harder to be eliminated by the method of sand wheel or sponge wheel grinding, or even vibrational grinding; these are the technical impediments ineliminable in the conventional techniques.

SUMMARY OF THE INVENTION

In view of the above statement, the conventional grinding and cutting techniques are hardly able of grinding the rough edges on and countersink-reaming on the interior bore rims of the two-dimensional bores, or on the interior/exterior bore rims of the three-dimensional bores. Such troubles in the processing techniques gave the present invention the motive of study and invention, therefore:

The object of the present invention is to provide a centrifugal rotational countersink reamer for three-dimensional interior/exterior bores, the countersink reamer can be easily mounted on a general electric (or pneumatic) hand tool or a mechanical claw, and is inserted into a rough bore, when it is activated, it can simultaneously abrase and eliminate rough edges on a two-dimensional or a three-dimensional interior/exterior bore rim as well as ream countersinks.

To achieve the above stated object, the technical measure used in the present invention is mainly to choose a screw typed flexible spring disposed along an axial direction as the frame of the countersink reamer, and to choose a screw spring slipping over and encircling the axial screw typed spring and having hardness and stiffness for cutting as a tool on the frame of the countersink reamer for grinding and cutting rough edges on the bore rims; and to make easy mounting and securing of the countersink reamer on a general electric (or pneumatic) hand tool or a claw on a drilling machine, and make it possible of inserting into a rough bore, when it is activated, it can create a centrifugal swivelling wiping action to render threads of the encircling screw spring to abrase the rough edges during rotation, and especially the rough edges on the three-dimensional interior/exterior bores located in the areas difficult for grinding, the scope of the centrifugal swivelling grinding action of the countersink reamer can be enlarged by increasing the speed of rotation, so that the countersink-reaming operation can be proceeded synchronically when the rough edges are eliminated.

The present invention will be apparent after reading the detailed description of the preferred embodiment thereof in reference to the accompanying drawings.

DETAILED DESCRIPTION OF THE PREFERRED EMBODIMENT

Figure 1:
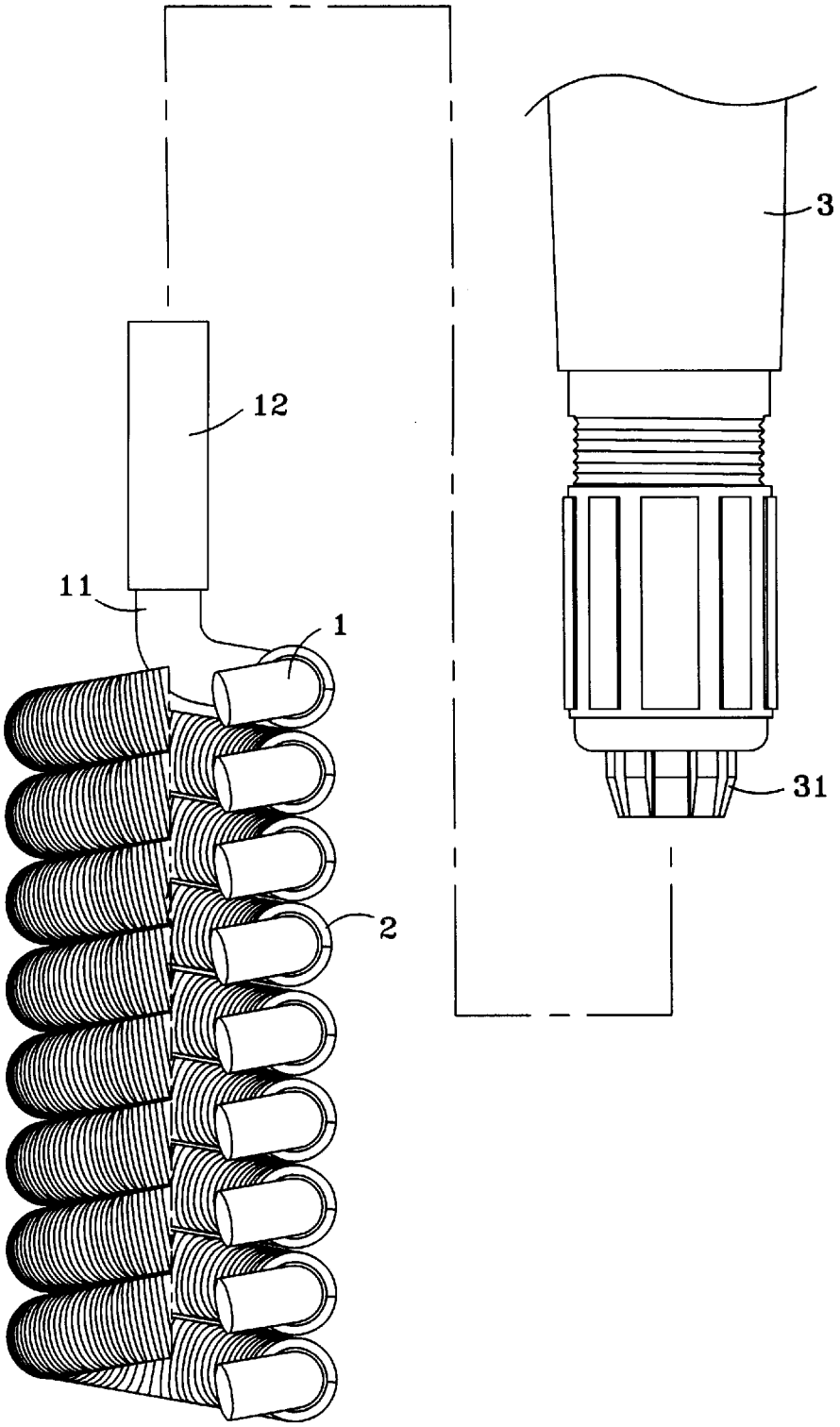
FIG. 1 is a schematic view showing mounting of the countersink reamer of the present invention.

Referring firstly to FIG. 1, the centrifugal rotational countersink reamer for three-dimensional bores of the present invention is comprised mainly of an axial screw typed spring 1 disposed along an axial direction and an encircling screw typed spring 2, the encircling screw typed spring 2 loosely slips over and encircles the threads of the axial screw typed spring 1, one end of the axial screw typed spring 1 forms a central rod 11 mounted in a cylindrical seat 12, so that the countersink reamer can be inserted and fixedly mounted in an electric (or pneumatic) hand tool 3 or a claw 31 on a drilling machine, the hand tool 3 can generate rotational power to render the countersink reamer on the claw 31 to create a centrifugal swivelling wiping action.

Figure 2:
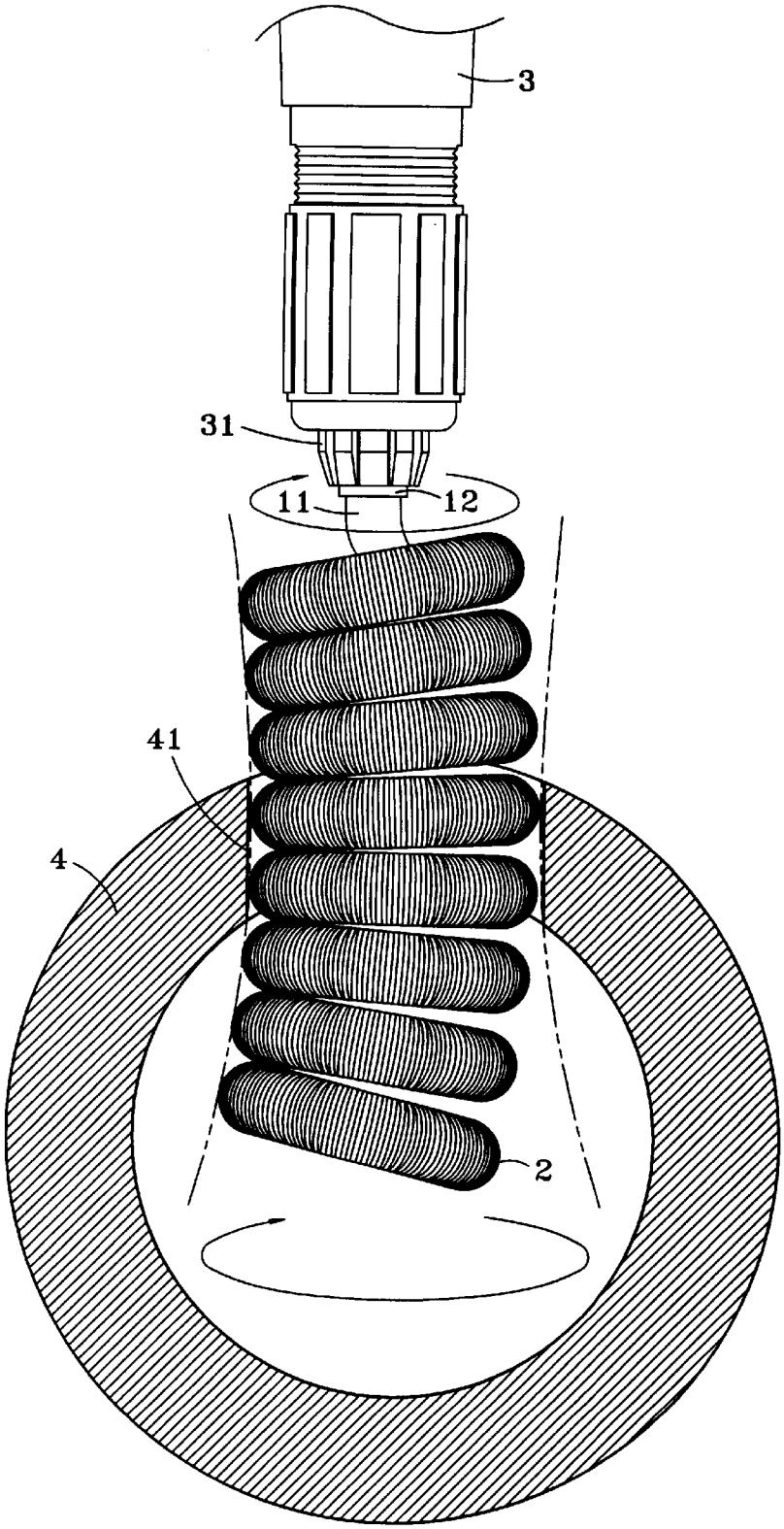
FIG. 2 is a partial sectional view showing the countersink reamer of the present invention is inserted into a bore for grinding.
Figure 3:
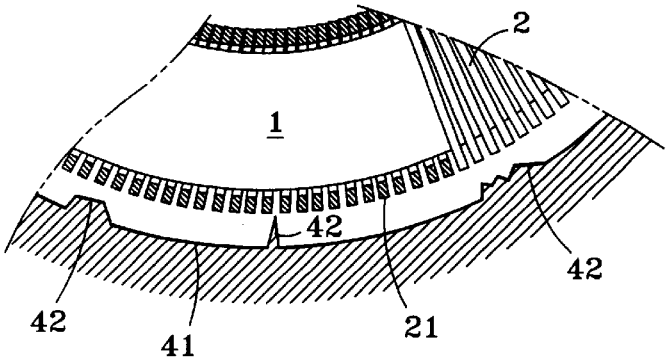
FIG. 3 is a sectional view showing a part of the countersink reamer of the present invention is inserted axially into a bore.

Thereby, the countersink reamer of the present invention can be practiced in a narrow area where a bore 41 is formed in a wall 4 having a three-dimensional contour (as shown in FIG. 2), so that the countersink reamer can be inserted into the bore 41 before activation, then the hand tool 3 is activated to rotate the countersink reamer, now the axial screw typed spring 1 creates a centrifugal swivelling wiping action during rotation, the threads of the encircling screw typed spring 2 thereby form grinding blades 21 (as shown in FIG. 3) to abrase during rotation the rough edges 42 in the bore 41.

Figure 4:
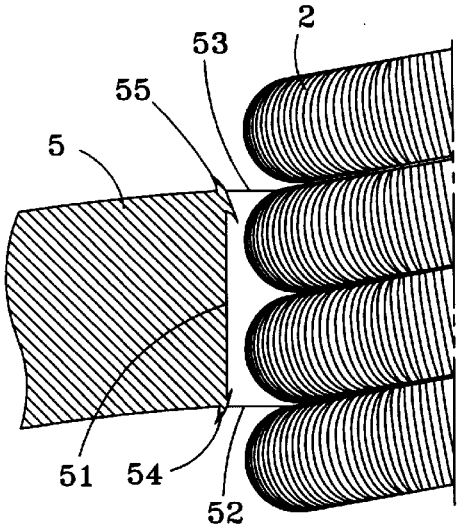
FIG. 4 is a partial sectional schematic view showing the countersink reamer of the present invention is used to grind the rough edge on a bore rim.
Figure 5:
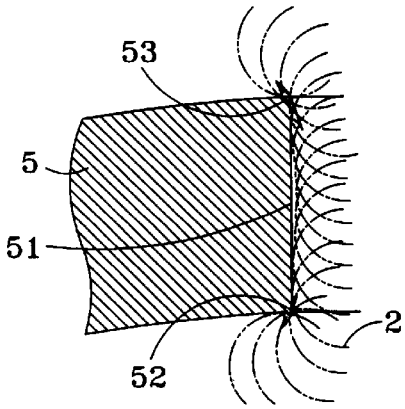
FIG. 5 is a sectional schematic view showing the countersink reamer of the present invention in the state of FIG. 4 is activated to grind and cut the rough edge on a bore rim and to ream a countersink.

Referring to FIG. 4, in the case of a bore 51 drilled on a three-dimensional arciform wall by a normal drilling bit, rough edges 54 and 55 tilt to the same direction as the direction of processing of the drilling bit on a three-dimensional interior bore rim 52 or a three-dimensional exterior bore rim 53, these rough edges 54 and 55 on the interior/exterior bore rims 52, 53, particularly the rough edge 54 on the interior bore rim 52, are harder to be abrased; however, using of the countersink reamer of the present invention can easily abrase during rotation with the encircling screw typed spring 2 and simultaneously ream a countersink (referring also to FIG. 5).

In addition, the countersink reamer of the present invention can be placed in a three-dimensional rough bore or in an arciform wall of a forged bore in advance before it is activated for rotational grinding, then operate the axial screw typed spring 1 which is curved in a screw shape to generate rotational movement, thereby the encircling screw typed spring 2 can too be used to grind the rough edges or residue in the bore wall, or on the three-dimensional interior/exterior bore rims, and even the rotation speed can be increased to execute countersink reaming on the bore rims.

And more, in choosing the diameter of the threads of the axial screw typed spring 1, it is required to choose in pursuance of the rotational speed of the hand tool 3 in order to get the desired scope of centrifugal swivelling action.

Accordingly, the shape of the section of any of the threads of the encircling screw typed spring 2 used on the countersink reamer of the present invention, except the rectangular shape forming the blades 21 having better grinding and cutting capability, can be round similar to the shape that the axial screw typed spring 1 has, so that they can suit various rough bores to be ground of different materials of various hardness; while the encircling screw typed spring 2 can be treated with titanium nitride depending upon requirement, thereby to enhance its grinding and cutting ability, smoothness and effect of heat insulation, and thereby in turn to increase its life of use.

In contusion, the scope of the technique of the present invention includes the technique using an axial screw typed spring wrapped by an encircling screw typed spring and mounted on an electric (or pneumatic) hand tool having rotational power or on a claw on a drilling machine, for the purpose of abrasing the rough edges in a rough bore, or on the interior/exterior bore rims, and includes countersink reaming on the bore rims; such technique can certainly solve the technical impediments resided in the conventional grinding and countersink reaming on bore rims, therefore, novelty, practicality as well as improveness are provided in the present invention.

Having thus described my invention which is a device needed in the industry of mechanical processing, what I claim as new and desire to be secured by letters patent of the United States are:

1. A centrifugal rotational countersink reamer for three-dimensional bores, being comprised of an axial screw typed spring and an encircling screw typed spring, said countersink reamer is mounted on an electric or pneumatic hand tool or a claw on a drilling machine providing rotational power, and being used for abrasing rough edges in a rough bore, or on three-dimensional interior/exterior bore rims, and for countersink reaming on said bore rims;

said countersink reamer is characterized in that:

said encircling screw typed spring loosely slips over and encircles the threads of said axial screw typed spring, one end of said axial screw typed spring forms a central rod mounted in a cylindrical seat, so that said countersink reamer is inserted and fixedly mounted in said hand tool or said claw on said drilling machine, said hand tool generates rotational power to render said countersink reamer to create a centrifugal swivelling wiping action to make said encircling screw typed spring abrase said rough edges in said rough bore or on said three-dimensional interior/exterior bore rims.

2. A centrifugal rotational countersink reamer for three-dimensional bores as in claim 1, wherein, the sectional shape of the threads of said encircling screw typed spring is rectangular or round.

* * * * *